US007749046B2

(12) United States Patent
Miva et al.

(10) Patent No.: US 7,749,046 B2
(45) Date of Patent: Jul. 6, 2010

(54) TOY VEHICLE

(75) Inventors: Filoseta Miva, El Segundo, CA (US); Jamie Cheung, Shen Zhen (CN)

(73) Assignee: Mattel, Inc., El Segundo, CA (US)

( * ) Notice: Subject to any disclaimer, the term of this patent is extended or adjusted under 35 U.S.C. 154(b) by 664 days.

(21) Appl. No.: 11/300,043

(22) Filed: Dec. 13, 2005

(65) Prior Publication Data

US 2006/0135036 A1 Jun. 22, 2006

Related U.S. Application Data

(63) Continuation of application No. PCT/CN2005/000684, filed on May 17, 2005.

(51) Int. Cl.
*A63H 17/00* (2006.01)

(52) U.S. Cl. ..... 446/462; 446/463; 446/465

(58) Field of Classification Search ..... 446/436, 446/443, 457, 462, 463, 465
See application file for complete search history.

(56) References Cited

U.S. PATENT DOCUMENTS

| | | | | |
|---|---|---|---|---|
| 2,006,156 | A | 6/1935 | Bonanno | |
| 2,604,727 | A | 7/1952 | Swenson | |
| 3,656,586 | A | 4/1972 | Robson | |
| 3,707,805 | A | 1/1973 | Buck | |
| 4,068,392 | A | 1/1978 | Montgomery et al. | |
| 4,087,935 | A | 5/1978 | Edmisson et al. | |
| 4,116,084 | A * | 9/1978 | Masuda | 74/342 |
| 4,141,256 | A | 2/1979 | Wilson et al. | |
| 4,241,534 | A | 12/1980 | Larsson et al. | |
| 4,312,151 | A | 1/1982 | Orenstein | |
| 4,333,261 | A | 6/1982 | Jones et al. | |
| 4,386,777 | A | 6/1983 | Prehodka | |
| 4,459,438 | A | 7/1984 | Kaiser | |
| 4,511,342 | A | 4/1985 | Hart et al. | |
| 4,516,954 | A | 5/1985 | Chow et al. | |
| 4,536,169 | A | 8/1985 | Fekete et al. | |
| 4,540,380 | A * | 9/1985 | Kennedy et al. | 446/463 |
| 4,541,815 | A | 9/1985 | Lee et al. | |

(Continued)

FOREIGN PATENT DOCUMENTS

| | | | |
|---|---|---|---|
| CN | 2228794 | Y | 6/1996 |

(Continued)

OTHER PUBLICATIONS

PCT International Search Report for Application No. PCT/CN/2005/000684, dated Sep. 29, 2005.

(Continued)

*Primary Examiner*—John Ricci
(74) *Attorney, Agent, or Firm*—Kolisch Hartwell, et al.

(57) ABSTRACT

A toy vehicle may include a drive unit; a plurality of wheels; mechanical linkage coupling the drive unit to one or more of the wheels to permit energy stored in the drive unit to be discharged to drive the one or more driven wheels and propel the vehicle; and a user operable selector mechanism configured to permit a user of the toy to select, from a plurality of different speeds, a desired speed at which the vehicle is propelled when energy from the drive unit is discharged through the one or more driven wheels.

36 Claims, 7 Drawing Sheets

U.S. PATENT DOCUMENTS

| | | | | |
|---|---|---|---|---|
| 4,568,309 | A | | 2/1986 | Maxim et al. |
| 4,579,544 | A | * | 4/1986 | Matsushiro ..... 446/427 |
| 4,680,021 | A | | 7/1987 | Maxim |
| 4,786,269 | A | | 11/1988 | Nagel et al. |
| 4,900,117 | A | | 2/1990 | Chen |
| 4,940,444 | A | | 7/1990 | Russell |
| 5,080,627 | A | | 1/1992 | Oriya et al. |
| 5,165,347 | A | | 11/1992 | Wagner |
| 5,273,480 | A | | 12/1993 | Suto |
| 5,342,048 | A | | 8/1994 | Jones et al. |
| 5,678,489 | A | | 10/1997 | Wang |
| 5,865,661 | A | | 2/1999 | Cyrus et al. |
| 5,931,714 | A | | 8/1999 | Johnson |
| 5,974,977 | A | | 11/1999 | Johnson et al. |
| 6,093,079 | A | | 7/2000 | House |
| 6,422,151 | B2 | | 7/2002 | Maleika |
| 6,482,070 | B2 | | 11/2002 | Hogan |
| 6,764,376 | B2 | | 7/2004 | Agostini et al. |

FOREIGN PATENT DOCUMENTS

| | | | |
|---|---|---|---|
| CN | 2228794 | Y | 1/2002 |
| CN | 2474203 | Y | 1/2002 |
| DE | 3409975 | | 3/1984 |
| DE | 3240712 | | 10/1984 |
| DE | 3500533 | | 7/1985 |
| DE | 3628961 | | 8/1986 |
| DE | 3941093 | | 6/1991 |
| EP | 0091971 | | 3/1982 |
| EP | 0105058 | | 10/1982 |
| EP | 0200837 | | 12/1985 |
| EP | 0280496 | | 2/1988 |
| EP | 1120144 | | 12/2000 |
| GB | 477953 | | 1/1938 |
| GB | 1380660 | | 2/1973 |
| GB | 1495374 | | 12/1977 |
| GB | 1533374 | | 11/1978 |
| GB | 2135895 | | 12/1983 |
| GB | 2148138 | | 10/1984 |
| GB | 2180768 | | 9/1986 |
| GB | 2230467 | | 3/1990 |
| WO | WO01/23058 | | 4/2001 |
| WO | WO03/101569 | | 12/2003 |
| WO | WO2004/016333 | | 2/2004 |

OTHER PUBLICATIONS

Abstract of German Patent No. DE3628961.
Abstract of European Patent No. EP1120144.
Abstract of German Patent No. DE3941093.
Abstract of German Patent No. DE3409975.
Abstract of European Patent No. EP0091971.
Foreign Office Statement dated Oct. 24, 2008 (including English-language translation), Chinese Patent Application No. 200410101475.6 of Filoseta MIVA et al., filed Dec. 16, 2004, 13 pages.
Foreign Office Statement dated Jan. 21, 2009, United Kingdom Patent Application No. 0711499.4 of Filoseta MIVA et al., filed May 17, 2005, 3 pages.
Foreign Office Statement dated Mar. 30, 2009, Canada Patent Application No. 2,591,392 of Filoseta MIVA et al., filed Jun. 15, 2007, 2 pages.
Foreign Office Statement dated May 8, 2009 (including English-language translation), Chinese Patent Application No. 200410101475.6 of Filoseta MIVA et al., filed Dec. 16, 2004, 14 pages.
Instituto Mexicano de la Propiedad Industrial; Office Action received in corresponding Mexican Patent Application No. MX/a/2007/007244; dated Aug. 12, 2009.
Basham, Ringe y Correa S.C.; Foreign agent's summary of Office Action issued Aug. 12, 2009 in corresponding Mexican Patent Application Serial No. MX/a/2007/007244; dated Sep. 9, 2009.
State Intellectual Property Office of P.R.C.; Office Action received in corresponding Chinese Patent Application No. 200410101475.6; dated Sep. 4, 2009.
UK Intellectual Property Office; Office Action received in corresponding United Kingdom Patent Application No. 0711499.4; dated Nov. 4, 2009.

* cited by examiner

TOY VEHICLE

CROSS REFERENCE TO RELATED APPLICATIONS

The present application claims foreign priority from Chinese Patent Application Serial No. 200410101475.6, filed Dec. 16, 2004, and PCT Patent Application Serial No. PCT/CN2005/000684, filed May 17, 2005, which applications are incorporated herein by reference in their entirety for all purposes. This application is also a continuation of PCT Patent Application Serial No. PCT/CN2005/000684 filed, May 17, 2005.

BACKGROUND

This disclosure relates to toy vehicles, particularly but not exclusively those of the type that might be played with by children. A toy vehicle may include a manually chargeable drive unit, configured so that on discharge of a charged drive unit the vehicle runs at a speed selected by the user from a plurality of available speeds.

Many different types of toy vehicles have previously been proposed. Toy vehicles with mechanisms for storing energy to drive the vehicle are found in Great Britain Patent Nos. 2135895 and 2148138 and U.S. Pat. Nos. 1,503,009; 2,006,156; 2,604,727; 2,830,403; 4,516,954; 4,541,815; 4,568,309; 4,680,021, 4,786,269 and 6,450,857, the disclosures of which are incorporated herein by reference.

For example, U.S. Pat. No. 6,450,857 (to Imagic, Inc. of Tokyo, Japan) discloses a four-wheel drive toy vehicle that can be pushed by hand to spin a flywheel contained within the body of the toy. On release of the vehicle, energy stored in the spinning flywheel is communicated, by a series of gears, to each of the four vehicle wheels and the vehicle moves backwards or forwards (depending on in which direction the vehicle was pushed to charge the drive unit) until the energy stored in the flywheel has discharged. This toy vehicle includes driven front wheels that can move vertically up and down to enable the vehicle to drive over small obstacles and rougher surfaces without coming to a halt.

SUMMARY OF THE DISCLOSURE

A toy vehicle may include a drive unit; a plurality of wheels; mechanical linkage coupling the drive unit to one or more of the wheels to permit energy stored in the drive unit to be discharged to drive the one or more wheels and propel the vehicle; and a user operable selector mechanism configured to permit a user of the toy to select, from a plurality of different speeds, a desired speed at which the vehicle will be propelled when energy from the drive unit is discharged through the one or more wheels.

In some examples, a selector system may include a gear train, a carrier for a gear train and a control mechanism. The gear train may include a plurality of gears, with each of the gears being associated with a particular propulsion speed being moveable into meshing engagement with mechanical linkage for connecting a drive unit to one or more wheels for driving the one or more wheels at the associated propulsion speed. The control mechanism may be arranged to control the movement of the carrier for the selection of a particular propulsion speed. The control mechanism may be retainable in a plurality of positions each of which is associated with a particular carrier position and hence a particular selected propulsion speed.

In some examples, a toy vehicle may include a chassis; a drive unit contained within the chassis; a plurality of wheels provided chassis; mechanical linkage provided within the chassis for coupling the drive unit to one or more of the wheels to permit energy stored in the drive unit to be discharged to drive the one or more driven wheels and propel the vehicle; a user operable selector mechanism configured to permit a user of the toy to select, from a plurality of different speeds, a desired speed at which the vehicle is propelled when energy from the drive unit is discharged through the one or more driven wheels. The selector system may include a carrier for a gear train and a control mechanism. The gear train may include a plurality of gears, each of which gears may be associated with a particular propulsion speed, and may be moveable into meshing engagement with mechanical linkage for connecting a drive unit to one or more wheels for driving the one or more wheels at the associated propulsion speed. The control mechanism may be arranged to control the movement of the carrier for the selection of the particular propulsion speed, the control mechanism being retainable in a plurality of positions each of which is associated with a particular carrier position and hence a particular selected propulsion speed. The vehicle further may include: an actuator pivotally mounted on the chassis and operable by the user to operate the user operable selector system; and bodywork that is capable of being coupled to the actuator, a depression of the bodywork towards the chassis being operable to pivot the actuator towards the chassis to effect operation of the user operable selector system.

Preferred features and advantages of these and other aspects and embodiments of toy vehicles are set out in the accompanying claims and elsewhere in the following description.

DESCRIPTION OF DRAWINGS

An example of a toy vehicle is described, by way of illustrative example only, with reference to the accompanying drawings, in which.

DETAILED DESCRIPTION

A toy vehicle will now be described that incorporates a flywheel as a drive unit, and mechanical linkage to provide four-wheel drive. It should be noted, however, that while the example described hereafter represents a particularly advantageous arrangement, the description is provided only by way of an illustrative example, with variations in combinations, sub-combinations, and characteristics of features being possible. No single feature or characteristic is necessary for all possible combinations or sub-combinations. It is eminently possible, for example, for a drive unit other than a flywheel to be used. It is also not essential that the vehicle be an all-wheel drive vehicle or a four-wheel vehicle.

Finally, it should also be noted that where relative positions and movements (such as top, bottom, front, rear, up, down, forwards and backwards) are mentioned hereafter, these terms are merely illustrative and as such should not be read as implying that the orientation of the vehicle or components thereof must be as specifically described.

Figure 1:
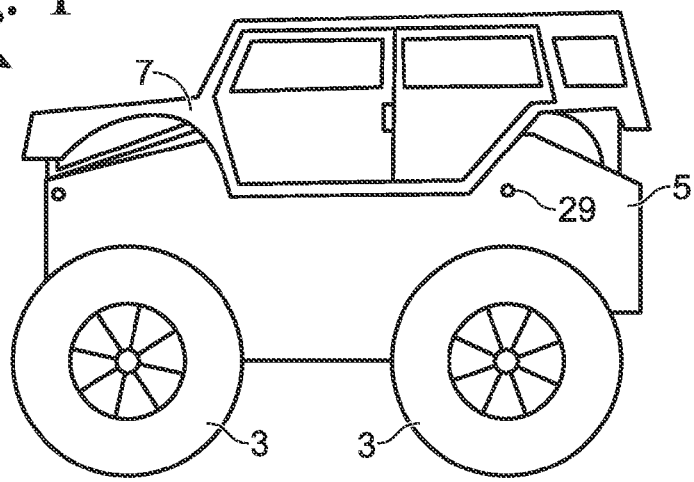
FIG. 1 is a side elevation of a toy vehicle.

Referring now to FIG. 1, there is shown in elevation a toy vehicle 1. The vehicle 1 comprises, in this illustrative embodiment, four wheels 3 (only two of which are visible) extending from a chassis 5. Bodywork 7, which may for example be representative of a real motor vehicle (in this particular instance a Hummer® vehicle), is coupled to the chassis 5.

Figure 2:
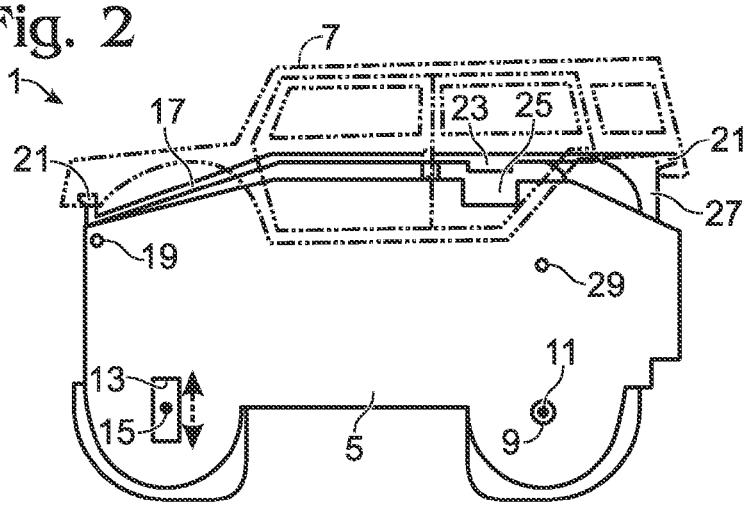
FIG. 2 is a side elevation of the vehicle depicted in FIG. 1 with certain components thereof removed, and others shown in ghost.
Figure 3:
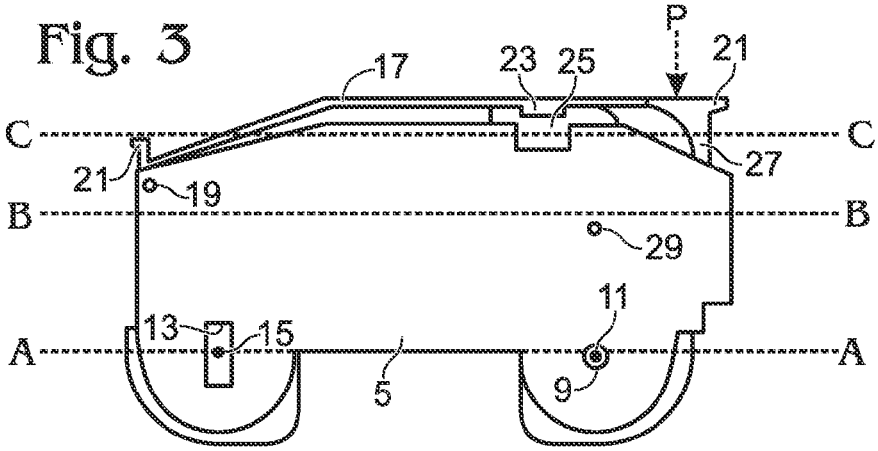
FIG. 3 is a side elevation of the vehicle depicted in FIG. 2 with yet further components thereof removed.

FIG. 2 is an elevation of the toy vehicle 1 depicted in FIG. 1 with the wheels 3 removed, and the bodywork 7 shown in ghost. FIG. 3 is a schematic representation of the vehicle as depicted in FIG. 2 with the bodywork 7 removed.

Referring now to FIGS. 2 and 3, the chassis includes a pair of holes 9, one on either side of the vehicle (only one being visible), through which a rear axle 11 extends. The rear axle 11 extends all the way through the vehicle and carries the rear wheels of the vehicle 1, one on either end of the axle.

The chassis also includes a pair of slots 13, one on either side of the vehicle (only one being visible), through which a front axle 15 extends. The front axle 15 extends all of the way through the chassis and is pivotable about a point inside the chassis to allow the front wheels to move "up" and "down" in the direction indicated.

The front axle 15 carries the front wheels (one on either end), and as the axle continues right through the chassis a movement of one front wheel upwards with respect to the chassis causes the other wheel to move downwards with respect to the chassis. As mentioned above, the pivoting front chassis makes it easier for the vehicle to negotiate small obstacles and rough ground.

An actuating member 17 is pivotally coupled (by means of a pivot pin 19 passed through the chassis) to the uppermost surface of the chassis 5. The actuating member includes front and rear tabs 21 that are snap-fittable into grooves or recesses formed in the underside of the bodywork 7 to attach the bodywork 7 to the vehicle.

The actuating member 17 carries a wedge-shaped cam 23 (the cam tapering in a direction into the plane of the paper) that is moveable, in a manner later to be described, to drive a cam follower 25 (in a direction into the plane of the paper) that forms part of a user operable selector mechanism. The actuating member 17 is pivotable, about the pivot pin 19, from the position indicated to a position where it lies closer to the uppermost surface of the chassis 5. The actuating member 17 includes a partly curved guide arm 27 that is flanged at its lowermost end (not visible) inside the chassis. Pivoting movement of the actuating member 17 causes the guide arm 27 to move into and out of the chassis 5, the flanged lowermost end of the guide arm 27 preventing the actuating member from being detached from the chassis 5.

As shown in FIGS. 1 to 3, the chassis 5 includes a further pair of holes 29 (one on each side of the chassis—only one of which is visible) through which a translatable gear train axle 31 extends. As will later be described the gear train axle can be translated (i.e. moved laterally—in a direction into the plane of the paper as depicted in FIGS. 1 to 3) to select different gear configurations and hence different running speeds.

Although not shown in the drawings, the chassis is split longitudinally (i.e. in a direction from the front axle to the rear axle) into two sections that are joined to one another, for example by means of a number of screws.

Figure 4:
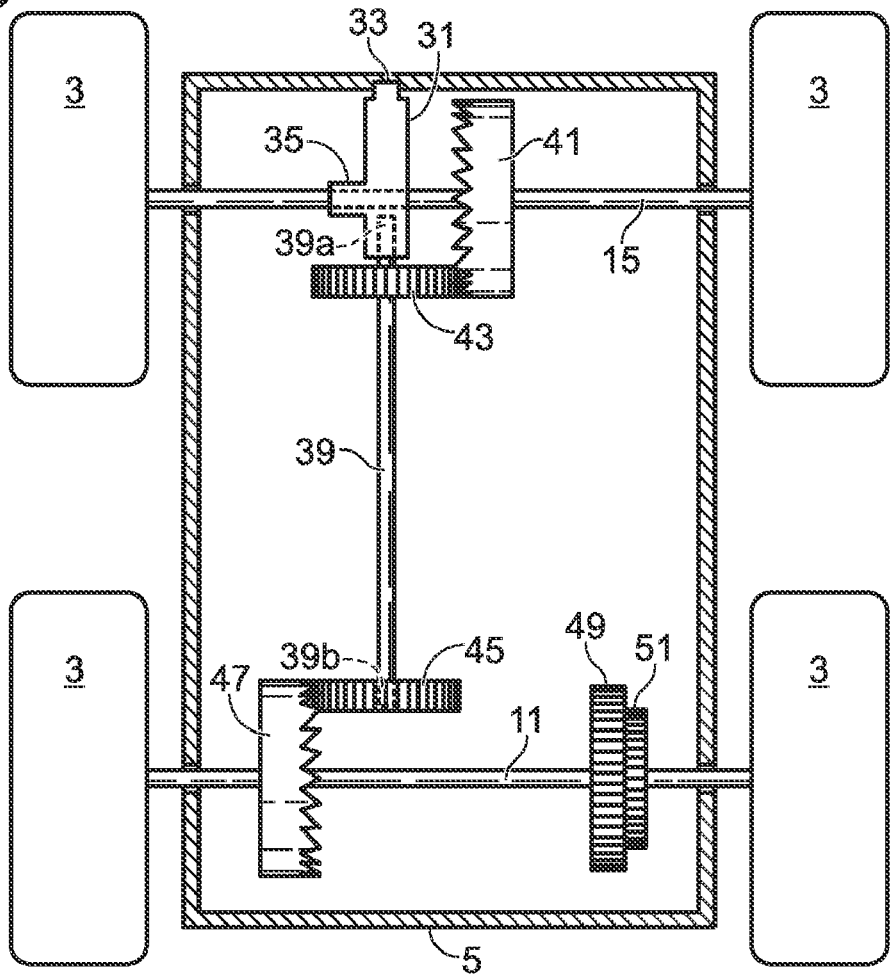
FIG. 4 is a plan view in cross-section along the line A-A in FIG. 3.

FIG. 4 is a plan view in cross-section generally along the line A-A in FIG. 3, illustrating the four-wheel drive mechanism aforementioned. The front and rear axles 15, 17 each carry a pair of wheels 3, one wheel at each end of the axles. Although the wheels are not shown in FIG. 3, they are included for illustration in FIGS. 4, 6, 7 and 9.

The front axle 15 extends through a pivot coupling 31 that comprises a pivot head 33 received in a notch in the wall of the chassis 5, a first channel 35 through which the front axle 15 extends, and a second channel 37 into which a proximal end 39*a* of a transmission shaft 39 is fitted in such a way that the transmission shaft 39 can rotate with respect to the pivot coupling 31.

The front axle 15 carries a crown gear 41 that is arranged to mesh with a first transmission gear 43 carried by the transmission shaft 39. The distal end 39*b* of the transmission shaft 39 carries a second transmission gear 45 that is arranged to mesh with a crown gear 47 carried by the rear axle 11. The rear axle crown gear 47 includes a clutch mechanism (shown in detail in FIG. 5).

The rear axle also carries two drive gears 49, 51—the smaller 51 of which may be formed as a pinion of the larger 49. In this preferred embodiment, the larger 49 of the two drive gears is driven (in a manner that is later described in detail) in a low-speed mode, and the smaller 51 is driven in a high-speed mode.

As will immediately be appreciated by those persons skilled in the art, driving either of the two drive gears 49, 51 rotates the rear axle, and the rear wheels 3 and crown gear 47 carried thereby. Rotation of the crown gear 47 causes the first and second transmission gears 43, 45 carried by the transmission shaft 39 to rotate, and the rotation imparted to the first transmission gear 43 is imparted to the crown gear 41 carried by the front axle 15 to drive the front wheels 3 of the vehicle.

Figure 5:
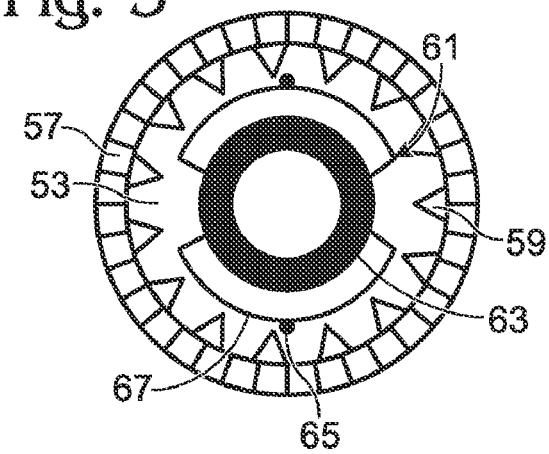
FIG. 5 is a plan view of a crown gear clutch mechanism as employed in the vehicle depicted in FIG. 4.

Referring now to FIG. 5, there is depicted a plan view of the crown gear 47 looking from the direction of the two drive gears 49, 51 along the rear axle 11.

The crown gear includes a recessed inner base surface 53 bounded by an upstanding peripheral wall 55 that carries the teeth of the crown gear 47. The base surface 53 includes a plurality of upstanding, generally triangular spaced teeth 59 that are arranged to interfere with projecting protuberances 65 formed on the periphery of a clutch 61. The clutch 61 comprises an annular ring 63 that is fixedly attached to the rear axle 11 so as to rotate with the axle. The protuberances 65 extend outwardly from the periphery of respective resilient arms 67 that extend from the annular ring 63 and are deformable (in the event of an excessive torque applied to the rear axle) towards the ring 63.

As depicted in FIG. 5, when the torque applied to the axle 11 is less than the force required to resiliently deform the arms 67 towards the ring 63, the protuberances abut against the aforementioned teeth 59 and the crown gear rotates with the axle 11. If the torque applied to the axle 11 should exceed the force required to resiliently deform the arms 67, the arms deform towards the ring 63 to draw the protuberances 65 out of abutment with the teeth 59 and the crown gear ceases to rotate with the rear axle 11.

This arrangement, whereby the clutch 61 is arranged to slip in the event of an excessive applied torque, is advantageous as it prevents damage that might otherwise occur (for example to the teeth 57 of the crown gear and the meshing teeth of the second transmission gear 45) were, for example, rotation of the front wheels to be impaired for some reason.

Figure 6:
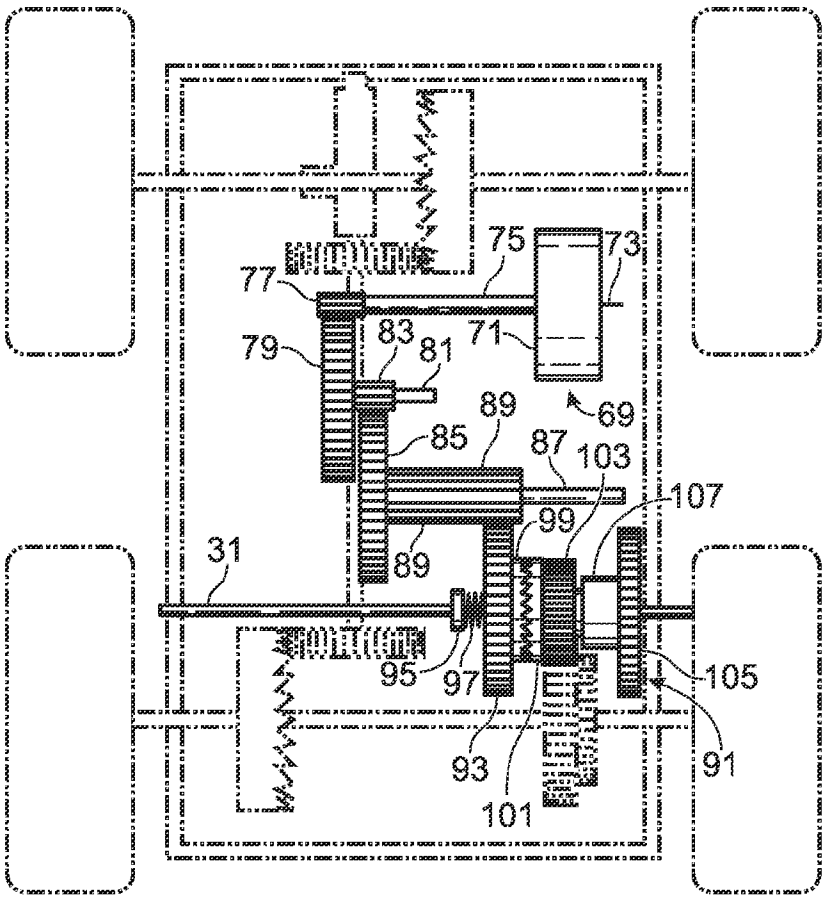
FIG. 6 is a plan view in cross-section along the line B-B in FIG. 3 (features depicted in FIG. 4 being shown in ghost) showing the configuration of the mechanical linkage for a first selected speed.

FIG. 6 is a plan view in cross-section generally along the line B-B in FIG. 3 of the vehicle when configured for operation in a low-speed mode. For convenience, and to aid understanding of the operation of this embodiment, features depicted in FIG. 4 are shown in ghost in FIG. 6.

Mounted within the chassis 5 is a drive unit 69, which in this example comprises a flywheel 71. The flywheel 71 is located in the chassis by means of a pivot pin 73 that enables the flywheel 71 to spin. The flywheel is engaged by a drive shaft 75, the distal end 75*a* of which is formed with a pinion 77. The pinion 77 meshes with a first gear wheel 79 that is located within the chassis by means of a second pivot pin 81. The first gear wheel 79 also comprises a pinion 83 that is arranged to mesh with a second gear wheel 85 that is located within the chassis by means of a third pivot pin 87. The second gear wheel 85 comprises an elongated pinion 89 that is arranged to mesh with a gear train 91 that is fixedly attached to the aforementioned translatable gear train axle 31.

The gear train 91 comprises a spur wheel 93 that moveable along the axle 31 and is normally biased away from a bush 95 by means of a spring 97. The spur wheel 93 meshes with the elongated pinion 89 and is formed with a ratchet 99 that meshes with a corresponding ratchet 101 formed on a first low speed gear wheel 103 that is fixedly attached to the axle 31. The spur wheel 93, ratchets 99, 101, low speed gear wheel 103 and spring 97 form a clutch mechanism that is operable to decouple the driven wheels and other gearing from the flywheel in the event that a torque should be applied to the translatable axle 31 that exceeds the lateral force exerted by the spring to bias the spur wheel 93 away from the bush 95.

The gear train further comprises a high-speed gear wheel 105 that is spaced from the low-speed gear 103 by toothless gripper section 107—the function of which will later be described. In a preferred arrangement, the ratchet 101, the low speed gear wheel 103, the toothless gripper section 107 and the high-speed gear wheel 105 are formed as one component of the gear train. As will be apparent by comparing FIGS. 4 and 6, the low speed gear wheel 103 is significantly smaller than the larger 49 of the two drive gears carried by the rear axle 11, and the high speed gear wheel 105 is significantly larger than the smaller 51 of the two drive gears carried by the rear axle 11.

As depicted in FIG. 6, in the low-speed mode the low-speed gear 103 meshes with the larger drive gear 49 carried by the rear axle. The effect of driving the larger drive gear 49 with a smaller low-speed gear wheel 103 is to reduce the angular velocity of the larger drive gear 49 as compared to that of the smaller low-speed gear 103, and hence reduce the angular velocity of the wheels and the overall speed at which the vehicle moves.

Figure 7:
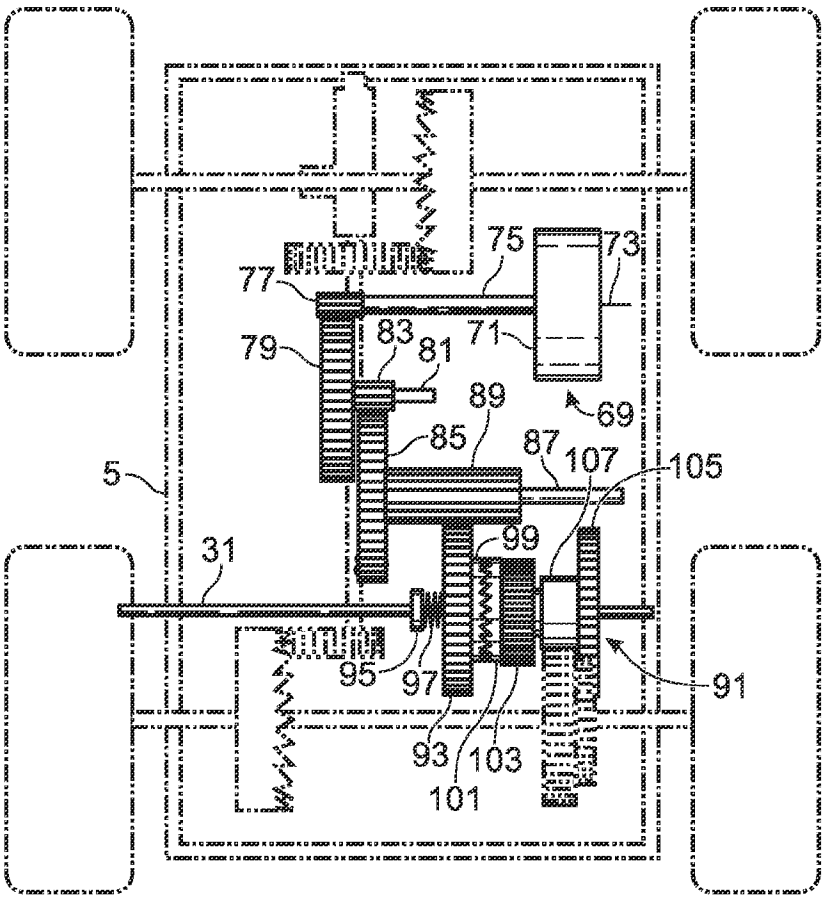
FIG. 7 is a plan view in cross-section along the line B-B in FIG. 3 (features depicted in FIG. 4 being shown in ghost) showing the configuration of the mechanical linkage for a second selected speed.

As mentioned above, FIG. 7 is a plan view in cross-section generally along the line B-B in FIG. 3 of the vehicle when configured for operation in a high-speed mode. Referring now to FIG. 7 (wherein the same elements as those in FIG. 6 are depicted in a different configuration), the principal depicted difference between the high-speed configuration and the low-speed configuration is that the gear train axle has been translated (i.e. moved laterally) towards the left of the figure to bring the low-speed gear 103 out of meshing engagement with the larger drive gear 49, and to bring the high-speed gear 105 into meshing engagement with the smaller drive gear 51, in this instance the larger high-speed gear wheel 105 meshes with the smaller drive gear 51 carried by the rear axle. The effect of driving the smaller drive gear 51 with a larger high-speed gear wheel 105 is to increase the angular velocity of the smaller drive gear 51 as compared to that of the larger high-speed gear 105, and hence increase the angular velocity of the wheels and the overall speed at which the vehicle moves.

As will now be apparent to those persons skilled in the art, moving the vehicle along a surface by hand causes the wheels to rotate which in turn (by virtue of the gearing depicted in FIG. 4) causes the drives gears 49, 51 to rotate. Depending on whether the vehicle is in the slow-speed mode or the high-speed mode, rotation of the drive gears 49, 51 causes either the first drive gear 49 to drive the low-speed gear wheel 103 of the gear train or the second drive gear 51 to drive the high-speed gear wheel 105 of the gear train. The coupling between the first and second ratchets 99, 101 transmits the drive imparted to the gear train 91 (by virtue of either the meshed low-speed and first drive gears 49,103 or the meshed high-speed and second drive gears 51, 105) to the spur wheel 93, and from there to the elongated pinion 89 and second gear wheel 85. The second gear wheel 85 meshes with and drives the pinion 83 of the first gear wheel 79, and the first gear wheel drives the pinion 77, drive shaft 75 and ultimately the flywheel 71.

As will be appreciated by those persons skilled in the art at each gear/pinion interface between the gear train 91 and the flywheel 71, the angular velocity of the gears is stepped-up—the effect of this being that the flywheel can be spun very rapidly even if the vehicle is only moved relatively slowly along a surface to drive the wheels.

Once the flywheel has been spun (by moving the vehicle along a surface by hand to rotate the wheels) to "charge" the drive unit 69, releasing the vehicle allows the flywheel to discharge the energy stored by driving the gearing described above to move the wheels, and hence propel the vehicle along the surface until the energy stored by the flywheel has dissipated.

While we have thus far described in detail how the drive mechanism of the vehicle functions, we have not as yet explained how the user interacts with the vehicle by means of a user operable selector mechanism to move the translatable gear train axle from the aforementioned low-speed configuration to the aforementioned high-speed configuration (and back again).

Figure 8:
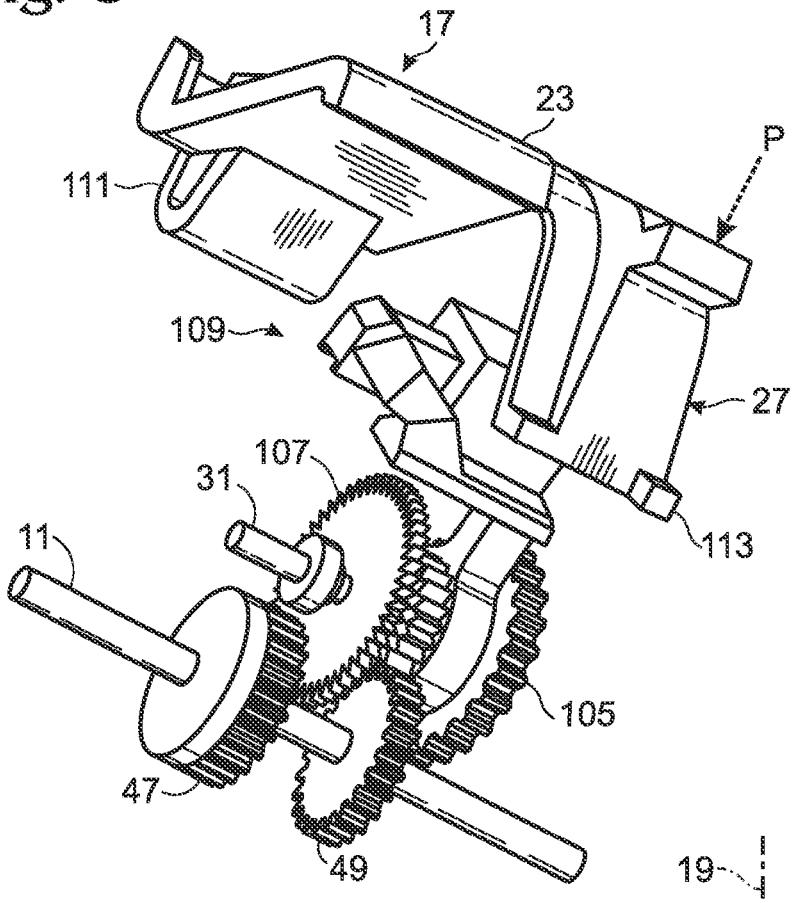
FIG. 8 is a tilted perspective view of a user operable selector mechanism and actuating member.

Referring now to FIG. 8 of the accompanying drawings, there is depicted a user operable selector mechanism (generally indicated by reference numeral 109). Also shown, in part, is the rear axle 11, the rear axle crown gear 47, the larger 49 of the two drive gears (the smaller 51 of the two drive gears being hidden from view), and the translatable gear train axle 31.

In FIG. 8 the hidden smaller drive gear 51 is meshed with the high-speed drive wheel 105 (in other words the vehicle is in the high-speed mode), and the toothless gripper section 107 of the gear train is located in a component of the user operable selector mechanism 109. The actuating member 17 (shown spaced from the user operable selector mechanism for clarity) includes a channel 111 through which the pivot pin 19 (see FIGS. 1 to 3) extends to enable the actuating member to be pivoted about the pin (as described above with reference to FIGS. 1 to 3). Also clearly visible on the underside of the actuating member 17 are the aforementioned wedge-shaped cam 23, and the flanged lowermost end 113 of the actuating member guide arm 27.

The user operable selector mechanism 109 will later be described in detail. It is sufficient at this point merely to mention that the toothless gripper section locates in the selector mechanism 109 so that rotation of the gear train 91 (with the gear train axle 31) is not impaired, and so that movement of the selector mechanism 109 carries with it the gear train 91 located therein.

Figure 9B:
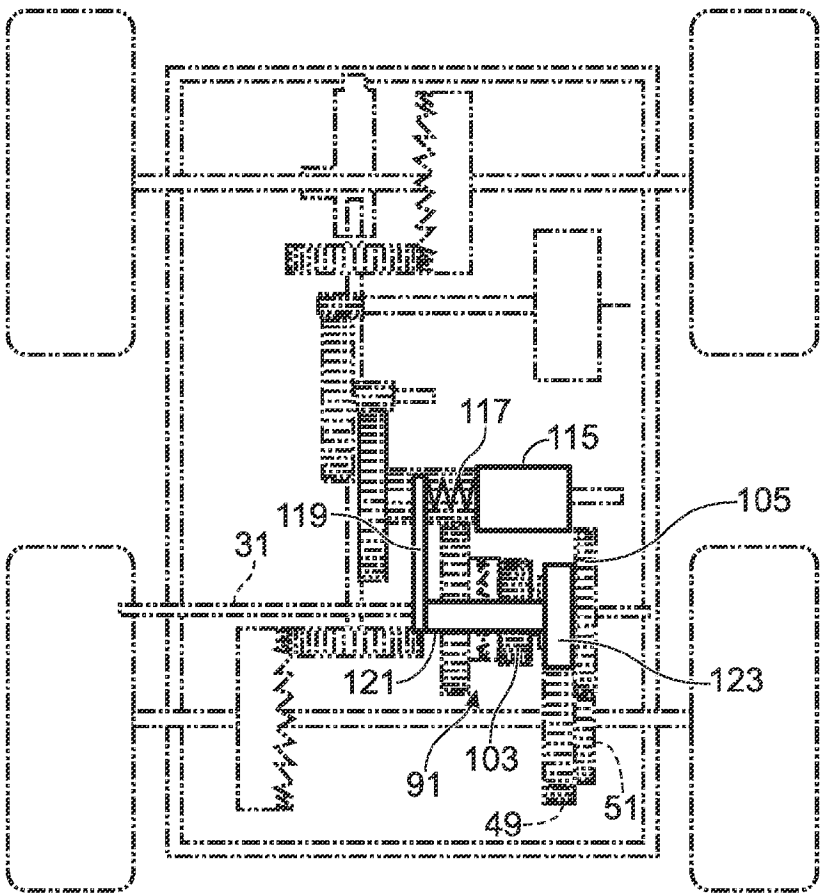
FIGS. 9*a* and 9*b* are plan views in cross-section along the line C-C in FIG. 3 showing, respectively, the configuration of the user-operable selector mechanism and the mechanical linkage for a first selected speed (as depicted in FIG. 6) and the configuration of part of the user operable selector mechanism and the mechanical linkage for a second selected speed (as depicted in FIG. 7)
Figure 9A:
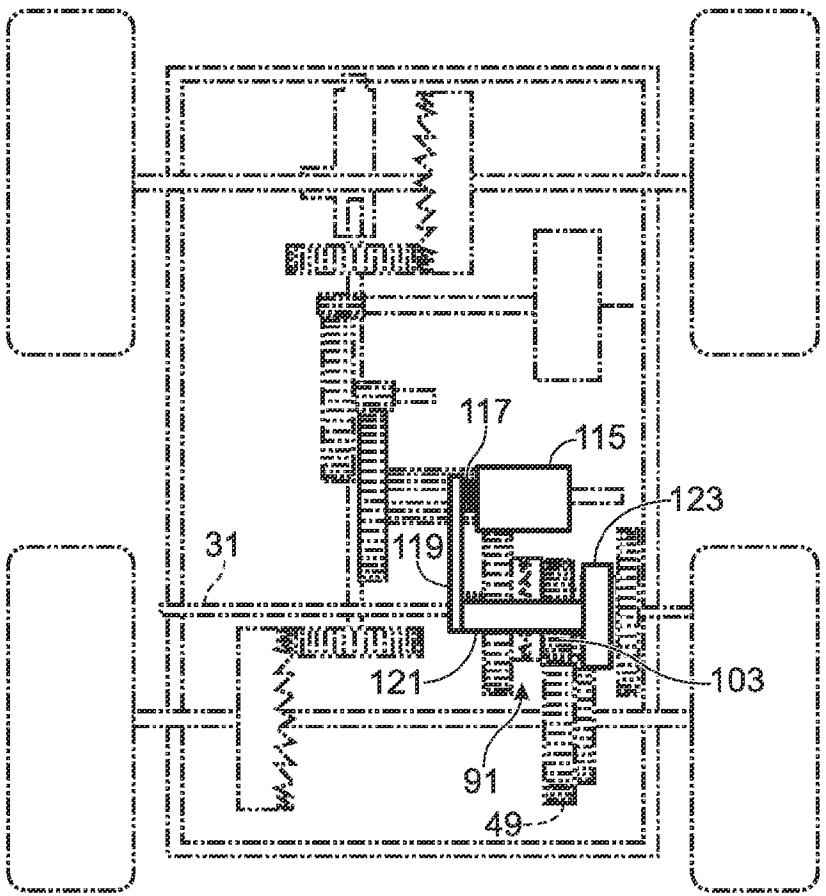

FIGS. 9*a* and 9*b* are plan views in cross-section along the line C-C in FIG. 3 showing, respectively, the configuration of the user-operable selector mechanism and the mechanical linkage for a first selected speed (as depicted in FIG. 6) and the configuration of part of the user operable selector mechanism and the mechanical linkage for a second selected speed (as depicted in FIG. 7);

Referring first to FIG. 9*a*, the user operable selector mechanism comprises a stationary housing 115 that locates in the chassis 5 (not shown) and remains fixed in position with respect thereto. A spring-biased shuttle 117, moveably retained within the housing 115, is coupled to a first arm 119 that extends generally perpendicularly from the housing and is coupled in turn to a second arm 121 that extends generally perpendicularly from the first arm 119 (and generally parallel to the gear train axle 31). The second arm is coupled to a third arm (not visible in FIGS. 9*a* and 9*b*) extending generally perpendicularly downwards (i.e. into the plane of the paper) and terminating in a crescent shaped notched portion 123 (somewhat akin to the mouth of a spanner) in which the aforementioned toothless gripper section 107 is located.

FIG. 9*a* shows a slow speed configuration wherein the shuttle 117 is locked (in a manner that is later described) against the spring bias in a position where it projects only slightly from the stationary housing 115. In this position the gear train is held (by virtue of the location of the toothless gripper section 107 in the notched portion 123) in a position whereby the low-speed gear wheel 103 meshes with the larger 49 of the two drive gears on the rear axle 11.

Operation, by the user, of the selector mechanism unlocks the shuttle 117, whereupon the shuttle 117 moves with the spring bias to project further from the stationary housing 115. As the shuttle moves out of the housing it carries with it the first, second and third arms 119, 121 and 123; the notched portion 123; the gear train 91 located in the notched portion 123; and the gear train axle 31. Movement of these components continues until the shuttle 117 reaches the limit of its movement out of the housing 115, at which point (as depicted in FIG. 9*b*) the low speed gear 103 has been moved out of meshing engagement with the larger 49 of the two drive gears, and the high speed gear 105 has been moved into meshing engagement with the smaller 51 of the two drive gears.

Subsequent operation of the user operable selector mechanism moves the shuttle 115 (against the spring bias) back to the locked position depicted in FIG. 9*a* wherein the gear train is in the low-speed configuration. Continued operation of the selector mechanism will cause the gear train to continue to switch between the two modes.

Figure 10:
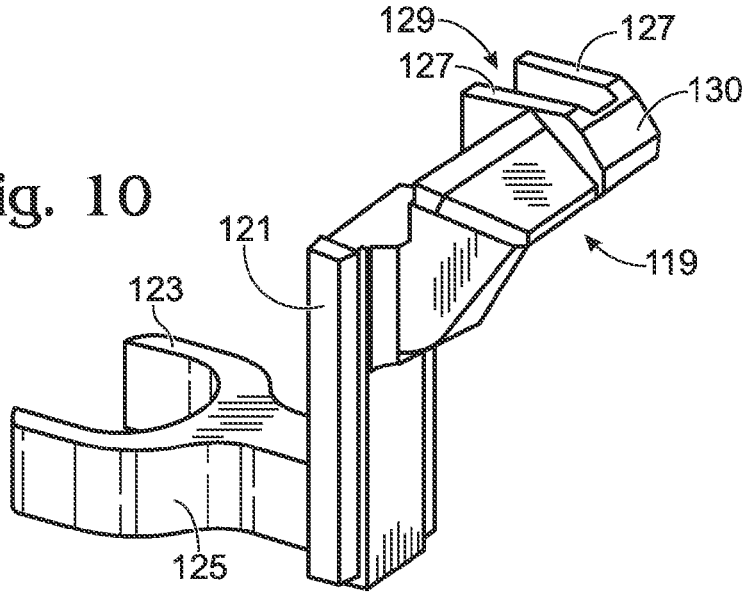
FIG. 10 is a perspective view of a component of the user operable selector mechanism.
Figure 11:
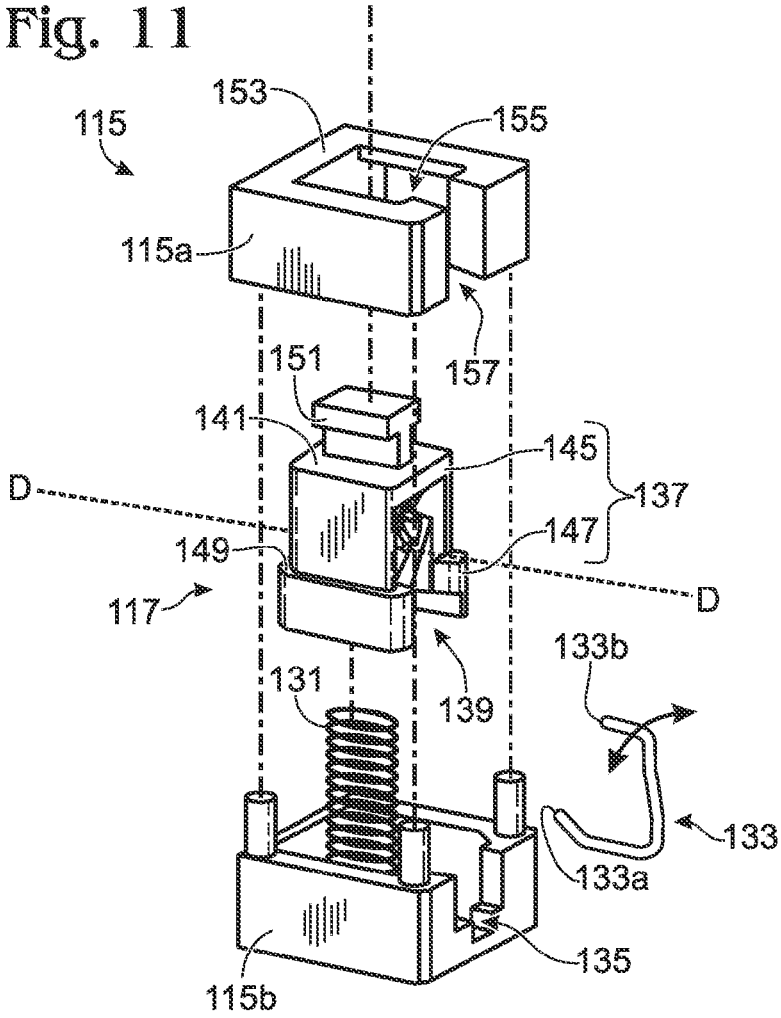
FIG. 11 is an exploded perspective view of another component of the user operable selector mechanism.

FIG. 10 is a perspective view of one principal component of the user operable selector mechanism, and FIG. 11 is an exploded perspective view of the various components that fit together to form the other principal component of the user operable selector mechanism.

Referring firstly to FIG. 10, clearly visible are the first 119, second 121 and third 125 arms—each of which extends generally perpendicularly from the other. Also clearly visible is the crescent shaped notched portion 123 in which the aforementioned toothless gripper section 107 of the drive train 91 (not shown in this figure) is located. The first arm 119 includes, at its proximal end 119*a* a pair of depending grip fingers 127 that extend in a direction generally parallel to the third arm 125. The grip fingers 127 define a slot 129 into which the other principal component of the selector mechanism (as depicted in FIG. 11) may be fitted. A face of the first arm 119, which points towards the underside of the actuating member 17 in use, is provided with an inclined section 130 that functions as the cam follower 25 (FIG. 1) for the wedge-shaped cam provided on the underside of the actuating member 17.

Referring now to FIG. 11, the other principal component is comprised of the housing 115 (comprised of first and second mateable housing parts 115*a* and 115*b*), the shuttle 117, a spring 131 operable to bias the shuttle 117 and a generally J-shaped hook 133 having a distal end 133*a* and a proximal end 133*b*. The proximal end 133*b* of the hook 133 functions as a cam track follower, as is later described in detail.

To assemble this component the distal end 133*a* of the hook 133 is fixed inside the second part 115*b* of the housing by engaging the distal end 133*a* with a fixing (not visible) provided generally in the centre of the base (not visible) of the second housing part 115*b*. Once fixed in place the proximal end 133*b* (and remainder of the spring) is upstanding from the base of the second part 115*b* and locates in a channel 135 formed in a wall of the second part 115*b* in such a way that the proximal end 133*b* of the hook 133 can pivot (within the confines of the channel 135) about the fixed distal end 133*a* in the direction indicated. Once the hook 133 has been fitted in place the spring 131 is fitted over the fixing in the base of the second housing part 115*b* so that the spring is also upstanding therefrom.

Figure 13:
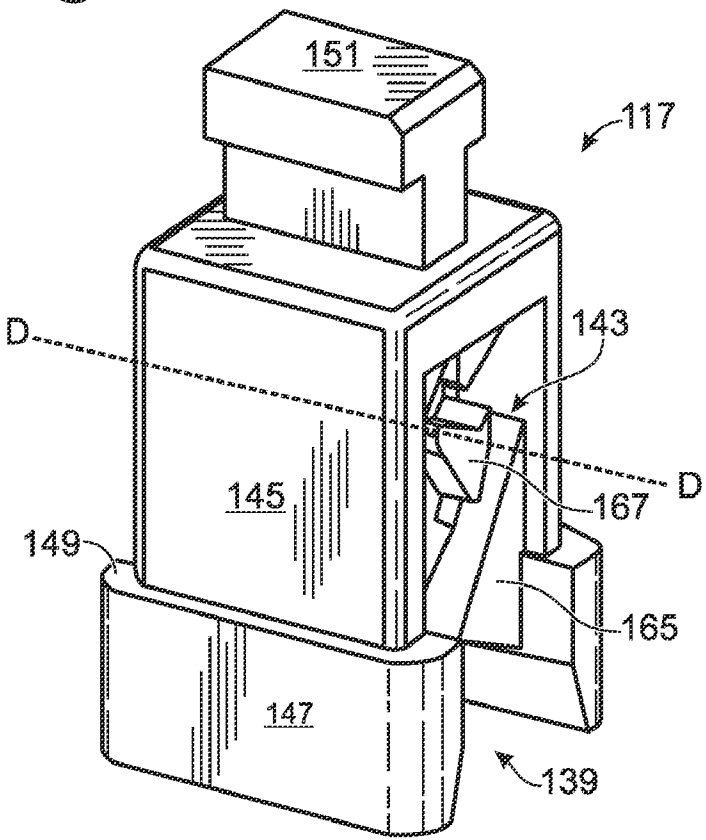
FIG. 13 is an enlarged perspective view of part of the component depicted, in an exploded view, in FIG. 11.

Referring now to FIGS. 11 and 13 (FIG. 13 providing an enlarged perspective view of the shuttle 117), the shuttle 117 includes a main body portion 137 that is generally H-shaped in cross-section (along the line D-D indicated in FIGS. 11 and 13) to define a first channel 139 and an opposing second channel (not visible) that are both open at one end (the bottom end as depicted) and closed at the other end by a top wall 141. The channels are arranged one behind the other and each of them open outwardly of the shuttle 117. The first channel 139 includes a cam track 143 (shown in detail in FIGS. 13 and 14), and as is apparent from FIG. 13 in particular, the cam track 143 is defined by a plurality of protrusions extending outwardly from the base of the first channel 139. The second channel is configured to receive the upstanding spring 131 therein. The main body portion 137 is comprised of a first section 145 and a larger second section 147, the interface between the first and second sections forming a circumferential step 149.

The top wall 141 of the shuttle 117 carries a generally T-shaped tab portion 151 that is configured so that the tab portion can be slidingly received in the slot 129 defined by the fingers 127 depending from the first arm 119 of the aforementioned one component of the user operable selector mechanism depicted in FIG. 10.

The first part 115*a* of the housing 115 includes a top wall 153 that is formed with a square aperture 155 that is sized to be slightly larger than the first section 145 of the shuttle 117 but smaller than the larger second section 147 of the shuttle 117 so that the shuttle 117 can move through the aperture 155 up to the point where the step 149 bears against the underside of the top wall 153. One sidewall of the first part 115*a* is formed with a channel 157 that functions as an extension of the channel 135 formed in the second part 115*b*. The second part 115*b* comprises a plurality of upstanding pins 159 that can be fitted into corresponding sockets (not visible) formed in the sidewalls of the first part 115*a*, to join the first part 115*a* to the second part 115*b*.

To complete the assembly of this component of the user operable selector mechanism, the shuttle 117 is located on the upstanding spring 131 so that the spring locates in the aforementioned second channel and the proximal end 133*b* of the J-shaped hook 133 locates at a start position 161 (FIG. 14) in the cam track 143 formed in the first channel 139. The first part of the housing 115*a* may then be fitted on the shuttle so that the smaller first section 145 thereof extends through the aperture 155 in the top wall 153, and moved towards the second housing part 115*b* to compress the spring 131 until the upstanding pins 159 are securely received in the complementary sockets formed in the sidewalls of the first part 115*b*.

Once assembled, the shuttle 117 will be biased by the spring 131 such that the circumferential step 149 bears against the underside of the top wall 153 of the housing 115 (and the shuttle projects from the housing to its greatest extent) and the proximal end 133*b* of the hook 133 locates at a start position 161 (FIG. 14) in the cam track 143.

Figure 12:
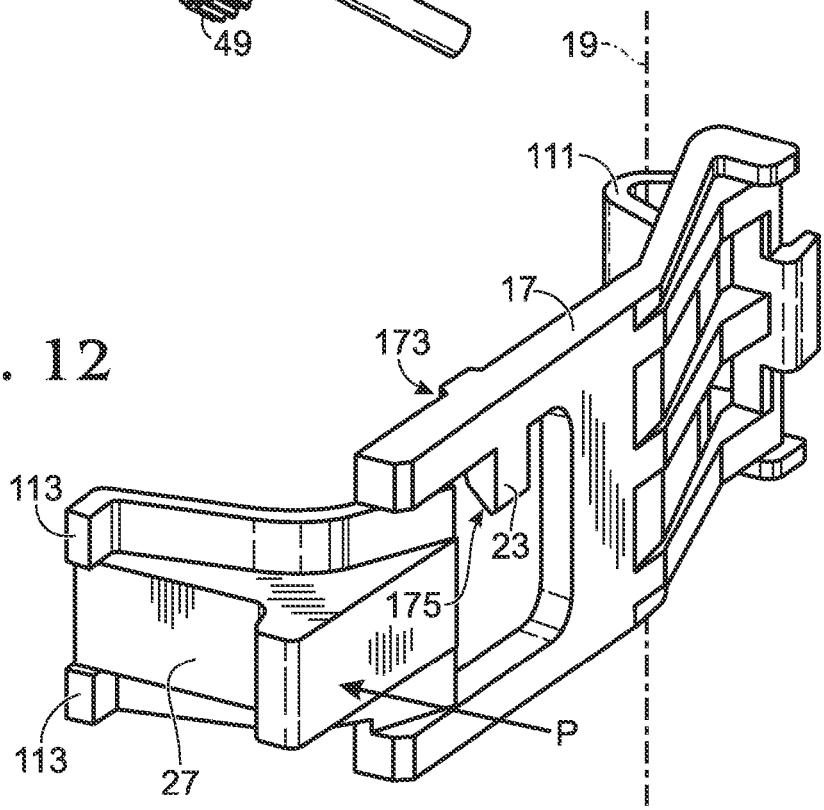
FIG. 12 is a perspective view of an actuating member for use with the user operable selector mechanism.

FIG. 12 is a perspective view of the actuating member 17 for use with the user operable selector mechanism described above with reference to FIGS. 10, 11 and 13. As mentioned above in connection with FIG. 8, the actuating member 17 includes a channel 111 through which the pivot pin 19 (see FIGS. 1 to 3) extends to enable the actuating member to be pivoted about the pin (as described above with reference to FIGS. 1 to 3). Also clearly visible on the underside of the actuating member 17 are the aforementioned wedge-shaped cam 23, and the flanged lowermost end 113 of the actuating member guide arm 27.

Figure 14:
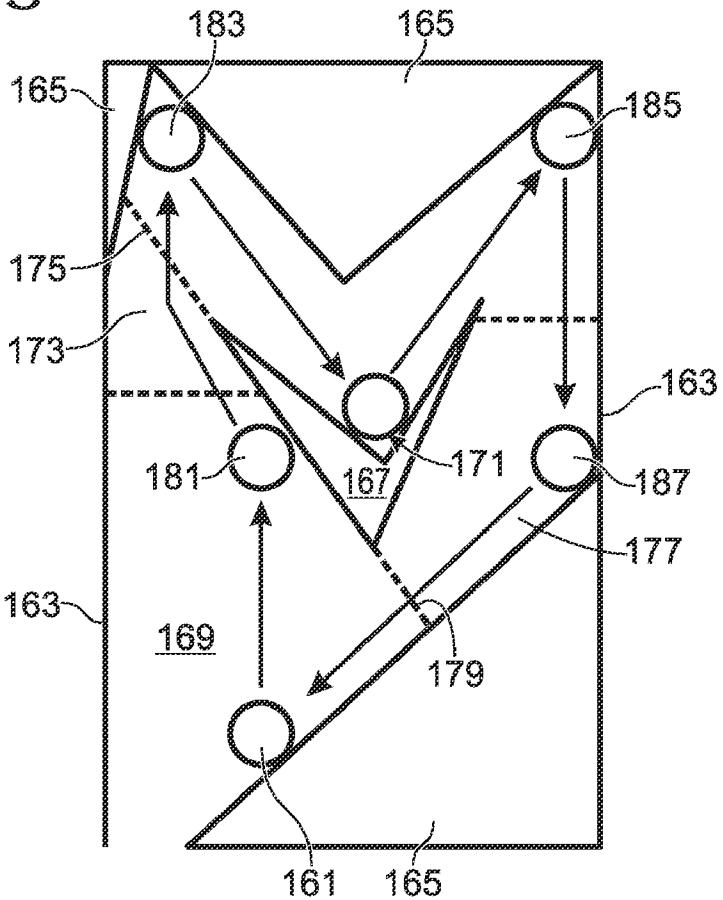
FIG. 14 is a schematic plan view of a cam track formed in a face of the component depicted in FIG. 13.

FIG. 14 is a schematic plan view of the cam track 143 formed in the first channel 139. As shown, the cam track 143 is defined both by the sidewalls 163 of the first channel 139 and a series of protuberances 165, 167 rising from the base 169 of the channel 139. A central protuberance 167 includes a locking notch 171, the function of which is later described.

The base 169 includes a first incline 173 (bounded by the dashed lines in FIG. 14) terminating at its highest point in a lip 175, and a second incline 177 (bounded by the dotted lines in FIG. 14) terminating at its highest point in a lip 179. The lips 175, 177 provide a means to prevent the cam follower (i.e. the proximal end 133*b* of the hook 133) from moving back down the incline (i.e. in a direction opposite to that indicated in FIG. 14).

Referring now to FIGS. 12 and 14, pivoting the actuating member 17 about the pivot pin 19 (by applying pressure thereto in the direction P indicated in FIGS. 3, 8 and 12) causes the wedge-shaped cam 23 to move to bear upon the cam follower 130 (formed on the first arm 119) at a point on the wedge-shaped cam generally indicated by reference numeral 173. As the cam 23 bears on the cam follower 130, the cam follower moves along the face of the cam 23 from the point 173 towards a point 175 and carries with it the first 119, second 121 and third 125 arms, and the gear train 91 located in the crescent shaped section 123. Movement of the cam follower from the point 173 to the point 175 also simultaneously causes the shuttle 117 (engaged with the fingers 127 depending from the first arm 119) to move against the bias of the spring to withdraw within the housing 115 (which, as mentioned previously, is fixed in position relative to the chassis and the other components of the user operable selector mechanism).

As the shuttle 117 withdraws within the housing 115, the proximal end 133*b* of the hook 133 moves from the start position 161 in the cam track 143 through an intermediate position 181, up the first incline 173, and over the lip 175 to a first limit point 183 where the spring 131 is compressed to its fullest extent and the shuttle 117 is close to bearing against the base of the second housing part 115*b*, and can withdraw no further into the housing. At this point, the actuating member 17 bears upon the upper surface of the chassis, and cannot be pivoted any further towards the chassis 5.

Considering now the configuration of the mechanical linkage at this limit point, it will be apparent to those persons skilled in the art, that as the shuttle withdraws within the housing, so the high-speed gear wheel 105 of the gear train 91 (which is located in the crescent shaped section 123 on the end of the third arm 125) moves out of meshing engagement with the smaller drive gear 51 (carried by the rear axle 11) and the low-speed gear wheel 103 moves into meshing engagement with the larger drive wheel 49. In other words, operating the selector mechanism to move the hook proximal end 133*b* from the start point 161 to the limit point 183 simultaneously causes the gear train 91 and translatable axle 31 provided within the chassis 5 to move from the position depicted in FIG. 7 or FIG. 9*b*, to the position depicted in FIG. 6 or FIG. 9*a*.

Releasing the actuating member 17 causes the shuttle 117 to move, under the action of the bias provided by the compressed spring 131, out of the housing 115 and simultaneously the distal end 133*b* of the hook 133 to move from the limit point 183 in the cam track 143 towards the central protuberance 167 and the locking notch 171 formed therein (the distal end 133*b* of the hook 133 being prevented from moving back down the incline 173 towards the start position 161 by the ridge 175). As the proximal end 133*b* of the hook 133 moves into the locking notch, so the gear train 91 moves back slightly from the limit position where the low-speed gear wheel 103 is fully meshed with the larger drive wheel 49 to a position where the low-speed gear wheel 103 and larger drive wheel 49 are meshed to a lesser extent, but still to an extent that readily permits the one to drive the other and vice versa.

When the proximal end 133*b* of the hook is in the locking notch 171 it is retained in that notch by virtue of the bias provided by the partly compressed spring 131, which acts to pull the proximal end into the notch. In this position, the low-speed gear wheel 103 is effectively locked in meshing engagement with the larger drive wheel 49 and any propulsion of the vehicle will occur at a relatively low speed. When the proximal end 133*b* of the hook 133 is located in the locking notch the actuating member 17 is slightly spaced from the upper surface of the chassis, but not as spaced as when the proximal end 133*b* of the hook 133 is in the start position 161.

On the reapplication of a force in the direction P to the actuating member, the actuating member moves once more into abutment with the upper surface of the chassis, and the proximal end 133*b* of the hook 133 moves to a second limit position 185.

Releasing the actuating member at this point again causes the shuttle 117 to move, under the action of the bias provided by the compressed spring 131, out of the housing 115 and simultaneously the distal end 133*b* of the hook 133 to move from the second limit point 185 in the cam track 143 past the central protuberance 167, up the second incline 177, through a second intermediate position 187 and over the second ridge 179 before coming to rest in the start position 161.

As the distal end of the hook 133*b* moves out of the second limit point 185, through the second intermediate point 187 to the starting position 161, the gear train 91 carried by the crescent shaped end 123 of the third arm 125 moves so that the low-speed gear wheel 103 disengages from meshing engagement with the larger 49 of the two drive wheels, and so that the high-speed gear wheel 105 moves into meshing engagement with the smaller drive gear 51. In other words, operating the selector mechanism to move the hook proximal end 133*b* from the second limit point 185 through the second intermediate point 187 to the starting point 161 simultaneously causes the gear train 91 and translatable axle 31 provided within the chassis 5 to move from the position depicted in FIG. 6 or FIG. 9*a* (the slow-speed configuration), to the position depicted in FIG. 7 or FIG. 9*b* (the fast speed configuration).

As will now be apparent to those persons skilled in the art, by repeatedly pressing and releasing the actuating member (or directly on the bodywork 7 of the vehicle) it is possible to switch between the low-speed and high-speed propulsion modes for the vehicle. This switching of propulsion speeds can be accomplished both before the vehicle is charged and set in motion, and while the vehicle is in motion, and will greatly increase the appeal and hence marketability of the toy as a whole.

While a toy vehicle has been described above in detail, it will be apparent to those persons skilled in the art that modifications and alterations may be made. For example, while the drive unit described comprises a flywheel, it will be apparent that a variety of different drive mechanisms could instead be utilized. Similarly, while switching between two discrete speed modes is described, it is apparent that switching between more than two speed modes could be accomplished by incorporating minor design changes in the embodiment disclosed. Furthermore, while the vehicle disclosed comprises four driven wheels, it is apparent that not all of the wheels need be driven. It is also apparent that the vehicle need not necessarily have four wheels. It could, for example, have a single wheel, two wheels, three wheels or more than four wheels.

A final point of note is that while certain combinations of features described herein have explicitly been enumerated in the accompanying claims, the scope of the present disclosure is not limited to those combinations set out in the claims at this time but instead extends to encompass any combination of features herein described irrespective of whether those features are claimed in combination hereafter. Accordingly, no single feature or element, or combination thereof, is essential to all possible combinations that may be claimed now or later. Thus, any given invention disclosed by example in the disclosure does not necessarily encompass all or any particular features, characteristics or combinations, except as specifically claimed.

Where "a" or "a first" element or the equivalent thereof is recited, such usage includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically indicated.

The invention claimed is:

1. A toy vehicle comprising:

a drive unit;

a plurality of wheels;

a mechanical linkage comprising a moveable gear train having a plurality of interconnected gears, the mechanical linkage coupling the drive unit to one or more of the wheels to permit energy from the drive unit to drive the one or more driven wheels and propel the vehicle, and the gear train comprising a clutch mechanism and a low-speed gear and a high-speed gear, the low-speed gear being moveable into the mechanical linkage between the drive unit and the one or more driven wheels to select a low propulsion speed, and the high-speed gear being moveable into the mechanical linkage between the drive unit and the one or more drive wheels to select a high propulsion speed; and a user operable selector mechanism configured to permit a user of the toy to select, from a plurality of different speeds, a desired speed at which the vehicle is propelled when energy from the drive unit drives the one or more driven wheels, the selector mechanism operable to move the gear train to change the configuration of the linkage to effect the selection of a desired speed at which the vehicle will be propelled;

wherein the user operable selector mechanism comprises a carrier in which the gear train locates, the carrier being moveable to effect the movement of the gear train and the selection of the desired propulsion speed, a control mechanism arranged to control the movement of the carrier for the selection of the particular propulsion speed, the control mechanism being retainable in a plurality of positions each of which is associated with a particular carrier position and hence a particular selected propulsion speed, and a resiliently biased shuttle, the shuttle being capable of being coupled to the carrier for movement;

wherein the control mechanism includes a housing fixed in position with respect to the vehicle, the shuttle being moveable with respect to the housing, and means for retaining the shuttle in a plurality of positions each of which is associated with a particular carrier position and hence a particular selected propulsion speed, wherein the retaining means comprises a cam track formed in a face of the moveable shuttle.

2. A vehicle according to claim 1, comprising a cam follower fixed to the housing and moveable through the cam track on operation of the user operable selector system.

3. A vehicle according to claim 2, wherein the shuttle locates inside the housing, the selector mechanism further comprises a resilient bias located between the shuttle and a base of the housing, the shuttle is moveable into and out of the housing, and the cam follower comprises a hook fixed at one end to the housing, a free end of the hook being moveable through the cam track.

4. A vehicle according to claim 3, wherein the cam track is configured so that the free end of the hook is movable from a start position through at least one retaining position and back to the start position.

5. A vehicle according to claim 4, wherein the hook free end is movable through the cam track only in one direction.

6. A vehicle according to claim 5, wherein the cam track is profiled to permit movement of the hook free end in only the one direction.

7. A vehicle according to claim 6, wherein the user operable selector system is configured to permit the user to select between a low vehicle propulsion speed and a high vehicle propulsion speed, and the gear train is configured such that:

(i) the high-speed gear is included in the mechanical linkage when the hook free end is in the cam track start position, (ii) the high-speed gear moves out of meshing engagement with the linkage and the low-speed gear moves into meshing engagement with the linkage as the hook moves from the start position through a first limit point to the retaining position to effect a selection of the low vehicle propulsion speed, and (iii) the low-speed gear moves out of meshing engagement with the linkage and the high-speed gear moves into meshing engagement with the linkage as the hook moves from the retaining position through a second limit point and to the start position to effect a selection of the high vehicle propulsion speed.

8. A vehicle according to claim 7, wherein action of the resilient bias to push the shuttle out of the housing pulls the free end of the hook into the retaining position.

9. A vehicle according to claim 8, wherein the retaining position comprises a notch in a cam track formation, the hook moving round the periphery of the formation as the user operable selector system is operated to select a low speed from a high speed, and to select a high speed from a low speed.

10. A vehicle according to claim 9, wherein the notch opens in the direction in which the shuttle is biased by the resilient bias to move out of the housing.

11. A vehicle according to claim 10, wherein the vehicle further comprises an actuator operable by the user to operate the user operable selector system.

12. A vehicle according to claim 11, wherein the vehicle comprises a chassis, and the actuator is hingedly mounted to the chassis.

13. A vehicle according to claim 12, wherein the actuator includes a cam such that on movement of the actuator towards the chassis, the cam bears on the coupling between the carrier and the control mechanism to move the user operable selector mechanism to operate the same.

14. A vehicle according to claim 13, wherein the actuator additionally comprises means for coupling bodywork to the vehicle.

15. A vehicle according to claim 14, wherein the coupling means comprises tabs formed on the actuator, the tabs being receivable in complementary recesses formed in the bodywork to couple the bodywork to the actuator.

16. A vehicle according to claim 15, wherein a depression of the bodywork towards the chassis being operable to pivot the actuator towards the chassis to effect operation of the user operable selector system.

17. A vehicle according to claim 16, further comprising four wheels.

18. A vehicle according to claim 17, wherein the mechanical linkage is configured such that the drive unit is operable to drive all four of the wheels.

19. A vehicle according to claim 18, wherein the drive unit is adapted to store energy and is manually chargeable.

20. A vehicle according to claim 19, wherein the drive unit is manually chargeable by moving the wheels of the vehicle over a surface to rotate the wheels and charge the drive unit.

21. A vehicle according to claim 20, wherein the wheels are rotated in the same direction to charge the drive unit, as the direction in which the wheels are rotated by the drive unit on discharge thereof.

22. A vehicle according to claim 21, wherein the drive unit comprises a flywheel.

23. A vehicle according to claim 1, wherein the selector system is user operable to select a desired propulsion speed while the drive unit is operating.

24. The toy vehicle of claim 1, wherein the moveable gear train includes a shaft and the plurality of interconnected gears are mounted on the shaft.

25. A user operable selector system for a toy vehicle having a drive unit and one or more wheels, and that can be propelled at any selected speed of a plurality of speeds, the selector system comprising:

a gear train including a plurality of speed-determining gears, each of the speed-determining gears being associated with a particular propulsion speed and being moveable to a respective gear position at which the speed-determining gear is in meshing engagement with a mechanical linkage for connecting a drive unit to one or more of the wheels for driving the one or more wheels at the associated particular propulsion speed;

a movable carrier for the gear train; and a control mechanism arranged to control the movement of the carrier for the selection of the particular propulsion speed, the control mechanism being retainable in a plurality of positions each of which is associated with a particular carrier position and gear position, and hence a particular selected propulsion speed;

wherein the control mechanism comprises a resiliently biased shuttle, the shuttle being capable of being coupled to the carrier for movement therewith, a housing fixed in position with respect to the vehicle, the shuttle being movable with respect to the housing, and means for retaining the shuttle in a plurality of positions each of which is associated with a particular carrier position and hence a particular selected propulsion speed, wherein the retaining means comprises a cam track formed in a face of the moveable shuttle.

26. A system according to claim 25, comprising a cam follower fixed to the housing and moveable through the cam track on operation of the user operable selector system.

27. A system according to claim 26, wherein the shuttle locates inside the housing, the resilient bias is located between the shuttle and a base of the housing, the shuttle is moveable into and out of the housing, and the cam follower comprises a hook fixed at one end to the housing, a free end of the hook being moveable through the cam track.

28. A system according to claim 27, wherein the cam track is configured so that the free end of the hook is movable from a start position through at least one retaining position and back to the start position.

29. A system according to claim 28, wherein the hook free end is moveable through the cam track only in one direction.

30. A system according to claim 29, wherein the cam track is profiled to permit movement of the hook free end in only the one direction.

31. A system according to claim 30, wherein the user operable selector system is configured to permit the user to select between a low vehicle propulsion speed and a high vehicle propulsion speed, and the gear train is configured such that:

(i) a high-speed gear is included in the mechanical linkage when the hook free end is in the cam track start position, (ii) the high-speed gear moves out of meshing engagement with the linkage and a low-speed gear moves into meshing engagement with the linkage as the hook moves from the start position through a first limit point to the retaining position to effect a selection of the low vehicle propulsion speed, and (iii) the low-speed gear moves out of meshing engagement with the linkage and the high-speed gear moves into meshing engagement with the linkage as the hook moves from the retaining position through a second limit point and to the start position to effect a selection of the high vehicle propulsion speed.

32. A system according to claim 31, wherein action of the resilient bias to push the shuttle out of the housing pulls the hook into the retaining position.

33. A system according to claim 32, wherein the retaining position comprises a notch in a cam track formation, the hook moving round the periphery of the formation as the user operable selector system is operated to select a low speed from a high speed, and to select a high speed from a low speed.

34. A system according to claim 33, wherein the notch opens in the direction in which the shuttle is biased by the resilient bias to move out of the housing.

35. A system according to claim 25, wherein the selector system is user operable to select a desired propulsion speed before the drive unit is charged, while the drive unit is being charged, or while the drive unit is discharging.

36. A toy vehicle comprising:

a chassis;

a drive unit contained within the chassis and adapted to store energy;

a plurality of wheels provided outside of the chassis;

a mechanical linkage provided within the chassis for coupling the drive unit to one or more of the wheels to permit energy stored in the drive unit to be discharged to drive the one or more driven wheels and propel the vehicle;

a user operable selector mechanism configured to permit a user of the toy to select, from a plurality of different speeds, a desired speed at which the vehicle is propelled when energy from the drive unit is discharged through the one or more driven wheels, the selector mechanism comprising:

(i) a carrier for a gear train, the gear train including a plurality of gears, each of the gears being associated with a particular propulsion speed being movable into meshing engagement with the mechanical linkage for connecting a drive unit to one or more wheels for driving the one or more wheels at the associated propulsion speed, and (ii) a control mechanism arranged to control the movement of the carrier for the selection of the particular propulsion speed, the control mechanism being retainable in a plurality of positions each of which is associated with a particular carrier position and hence a particular selected propulsion speed;

the vehicle further comprising:

an actuator pivotally mounted on the chassis and operable by the user to operate the user operable selector system; and bodywork that is capable of being coupled to the actuator, a depression of the bodywork towards the chassis being operable to pivot the actuator towards the chassis to effect operation of the user operable selector system.

* * * * *